US011142358B2

(12) United States Patent
Schubert

(10) Patent No.: US 11,142,358 B2
(45) Date of Patent: Oct. 12, 2021

(54) METHOD AND MACHINE FOR PRODUCING LONGITUDINALLY AND TRANSVERSALLY SEALED FOIL BAGS FROM A NON-FORM STABLE FOIL SHEET

(71) Applicant: Gerhard Schubert GmbH, Crailsheim (DE)

(72) Inventor: Gerhard Schubert, Crailsheim (DE)

(73) Assignee: Gerhard Schubert GmbH, Crailsheim (DE)

( * ) Notice: Subject to any disclaimer, the term of this patent is extended or adjusted under 35 U.S.C. 154(b) by 0 days.

(21) Appl. No.: 16/135,473

(22) Filed: Sep. 19, 2018

(65) Prior Publication Data

US 2019/0092508 A1 Mar. 28, 2019

(30) Foreign Application Priority Data

Sep. 22, 2017 (DE) ..... 102017121988.9

(51) Int. Cl.

| | |
|---|---|
| ***B65B 11/12*** | (2006.01) |
| ***B65B 43/10*** | (2006.01) |
| ***B65B 51/16*** | (2006.01) |
| ***B65B 11/10*** | (2006.01) |
| ***B65B 41/12*** | (2006.01) |
| ***B65B 51/22*** | (2006.01) |
| ***B65B 11/00*** | (2006.01) |

(52) U.S. Cl.

CPC ..... *B65B 11/004* (2013.01); *B65B 11/105* (2013.01); *B65B 11/12* (2013.01); *B65B 43/10* (2013.01); *B65B 51/16* (2013.01); *B65B 41/12* (2013.01); *B65B 51/225* (2013.01)

(58) Field of Classification Search

CPC ..... B65B 51/30; B65B 51/303; B65B 51/306; B65B 11/004; B65B 11/105; B65B 11/48; B65B 5/045; B65B 5/022; B65B 9/08–093; B65B 43/10; B65B 45/00; B65B 25/06; B65B 2220/18; B65B 9/06; B65B 9/067; B65B 9/073; B65B 43/02; B65B 43/14; B65B 41/04; B65B 41/06; B65B 19/228; B65B 5/024; B65B 43/123; B65B 43/08; B31B 70/04; B31B 70/022; B29C 66/8491

USPC ..... 53/450, 550, 553, 209, 461, 463

See application file for complete search history.

(56) References Cited

U.S. PATENT DOCUMENTS 1,711,228 A * 4/1929 Duvall ..... B65B 27/08 53/526
2,530,400 A * 11/1950 Rado ..... B65B 9/12 53/469

(Continued)

FOREIGN PATENT DOCUMENTS

DE 68920701 6/1995
DE 102012103820 8/2013

(Continued)

*Primary Examiner* — Joshua G Kotis

(74) *Attorney, Agent, or Firm* — Head, Johnson, Kachigian & Wilkinson, PC

(57) ABSTRACT

In order to be able to produce foil bags in a more flexible manner it is proposed according to the invention to transport individual foil sheets (100) instead of using the continuous flow pack method by using independently moveable transport slides (120) of a flexible transport device (111) and filling, erecting and sealing the foil bags.

17 Claims, 11 Drawing Sheets

(56) References Cited

Figure 1A:
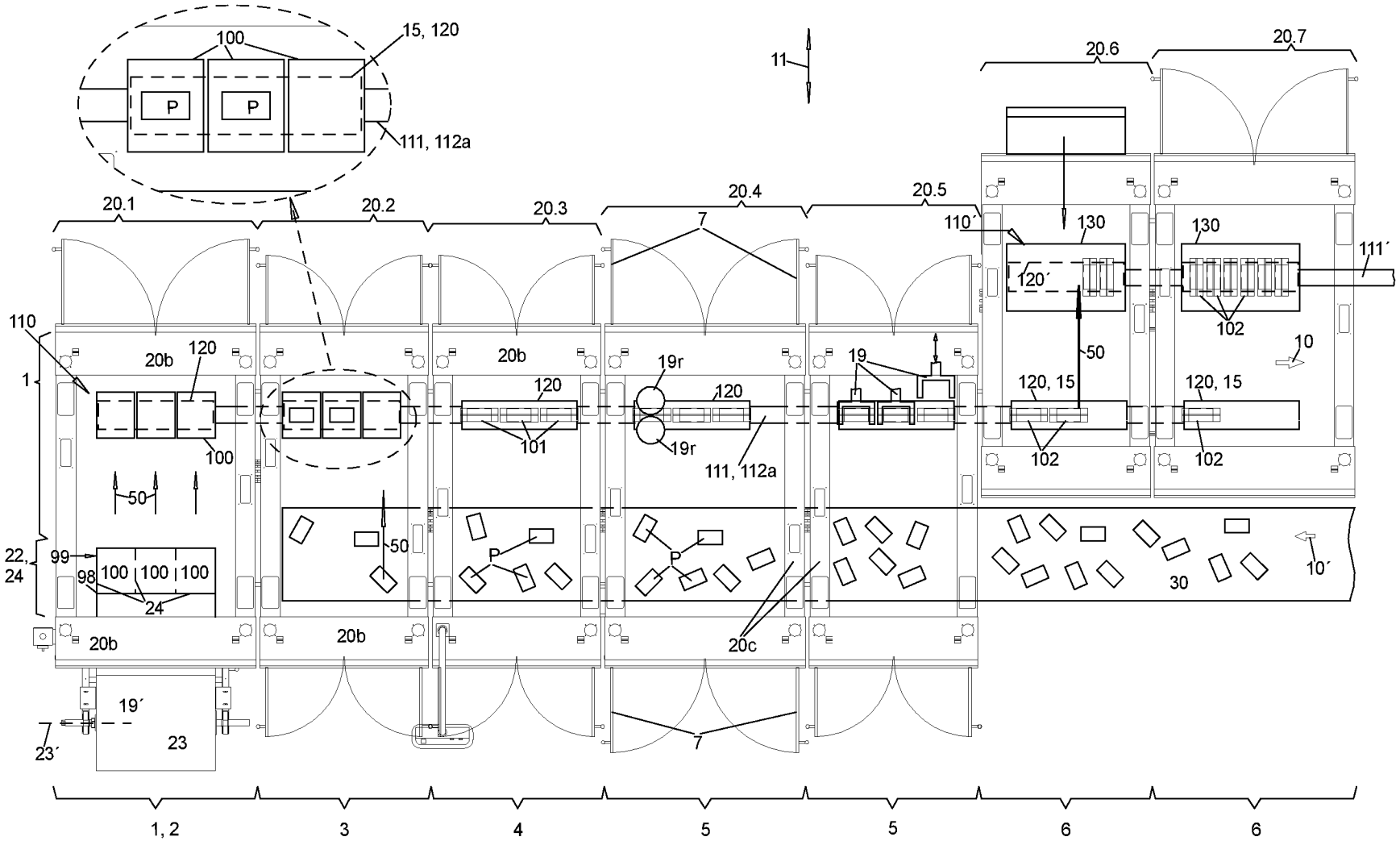

U.S. PATENT DOCUMENTS 2,600,216 A * 6/1952 Denison ..... B65B 9/06 426/394
2,764,862 A * 10/1956 Pickering ..... B29C 65/18 53/374.8
3,229,442 A * 1/1966 Gram ..... B65B 9/06 53/450
3,274,746 A * 9/1966 James ..... B65B 31/04 53/433
3,375,636 A * 4/1968 Redmond ..... B65B 25/06 53/122
4,520,615 A * 6/1985 Engler ..... B65B 9/06 493/248
4,596,111 A * 6/1986 Ambrose ..... B65B 23/00 53/170
4,869,051 A * 9/1989 Shifley ..... B29C 66/81871 53/540
6,061,996 A * 5/2000 Vissers ..... B65B 5/105 198/411
6,122,895 A * 9/2000 Schubert ..... B65B 5/12 53/240
6,799,409 B2 * 10/2004 Altvater ..... A01J 21/02 53/122
6,876,896 B1 * 4/2005 Ortiz ..... B29C 66/8351 700/112
7,644,558 B1 * 1/2010 Fallas ..... B25J 9/0093 53/251
2009/0126322 A1 * 5/2009 Fuellemann ..... B65B 5/024 53/475
2013/0152516 A1 * 6/2013 Sammons ..... B65B 7/02 53/562
2015/0307218 A1 * 10/2015 Rasi ..... B65B 35/44 53/439
2015/0375880 A1 * 12/2015 Ford ..... B65B 49/14 53/443

FOREIGN PATENT DOCUMENTS

EP 0368240 5/1990
EP 2070843 6/2009
EP 2070843 A1 * 6/2009 ..... B65G 54/02
EP 2078676 7/2009
EP 2078676 A1 * 7/2009 ..... B65B 5/024
EP 2116489 11/2009
EP 2420459 2/2012
GB 802743 A * 10/1958 ..... B65B 11/08
WO WO2006038486 4/2006
WO WO2013092081 6/2013
WO WO-2013092081 A1 * 6/2013 ..... B65B 11/06

* cited by examiner

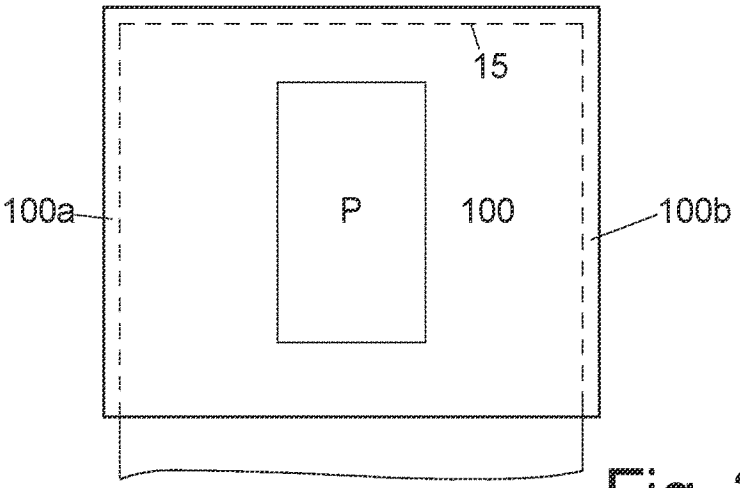
Fig. 2a1
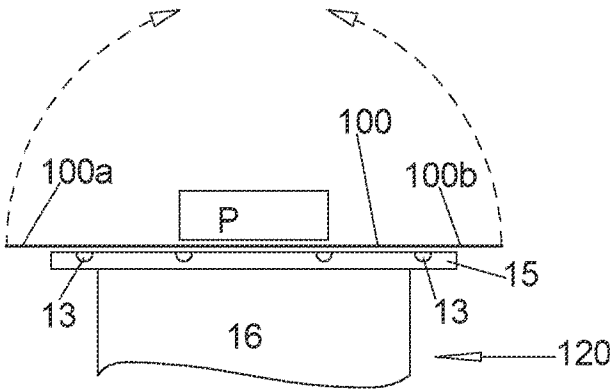
Fig. 2a2
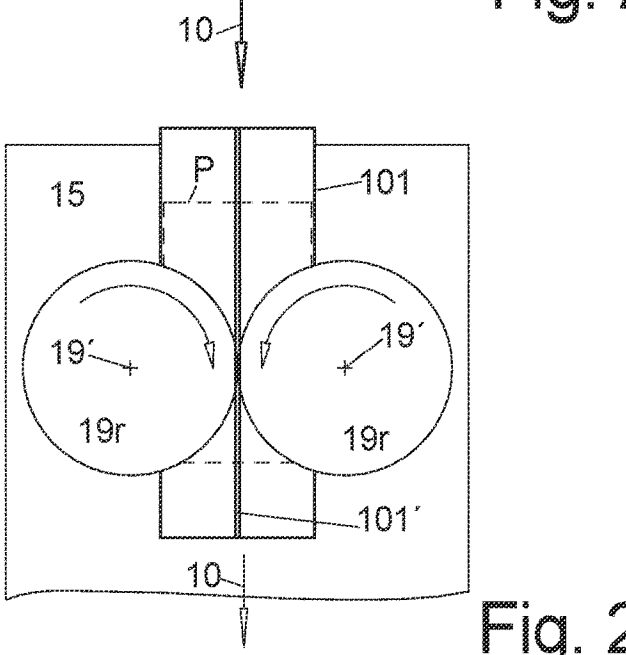
Fig. 2b1
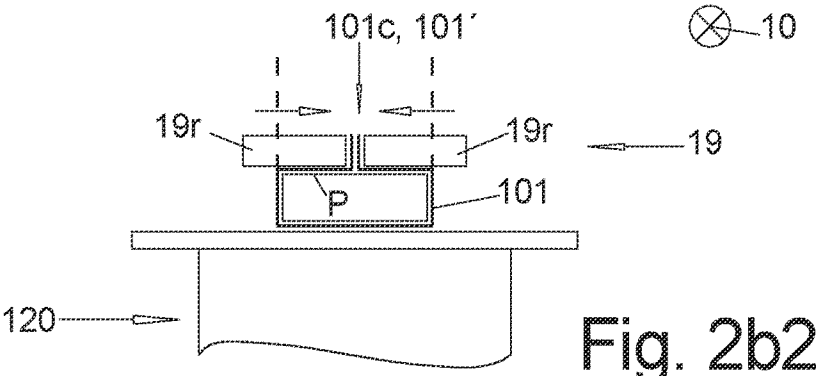
Fig. 2b2

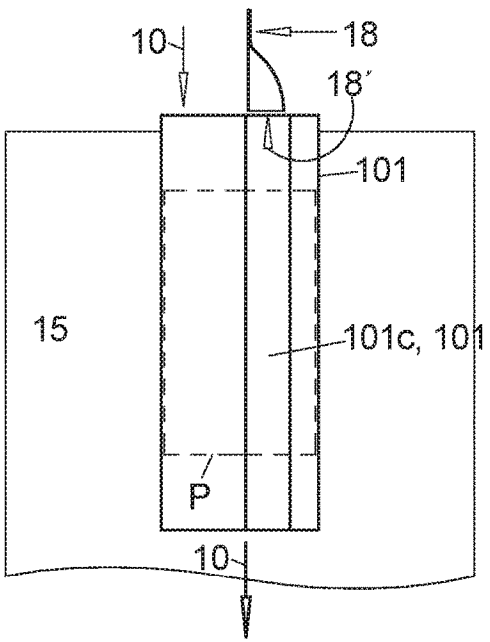
Fig. 2c1
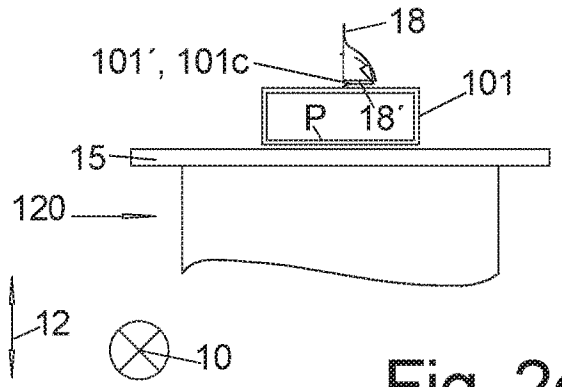
Fig. 2c2
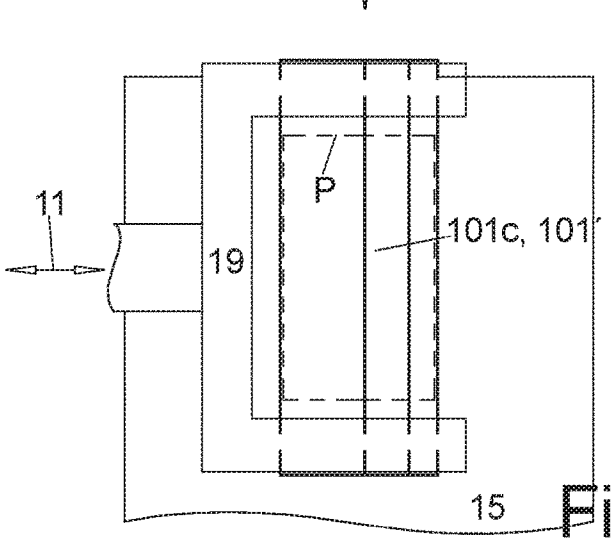
Fig. 2d1
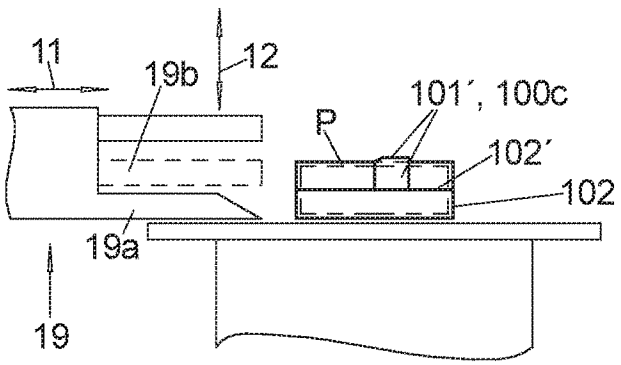
Fig. 2d2
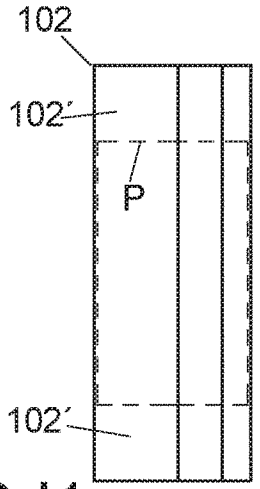
Fig. 2e1

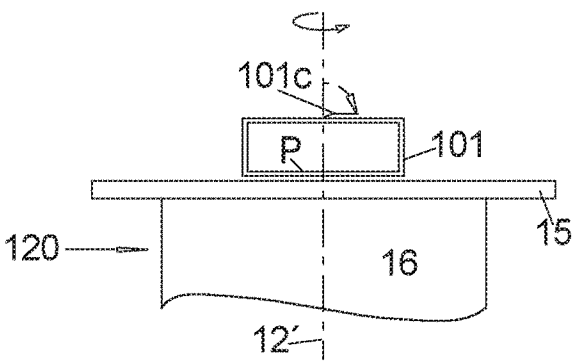
Fig. 3c2
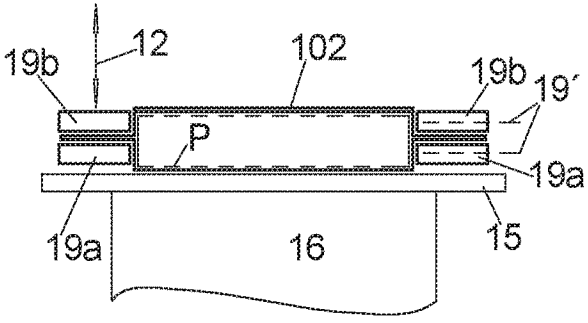
Fig. 3d2
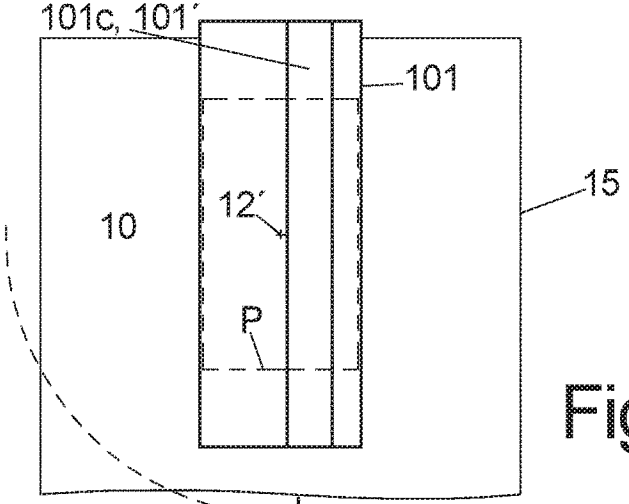
Fig. 3c1
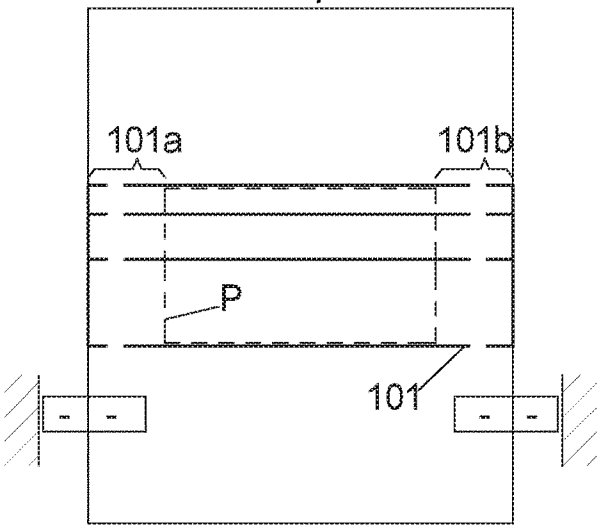
Fig. 3d1
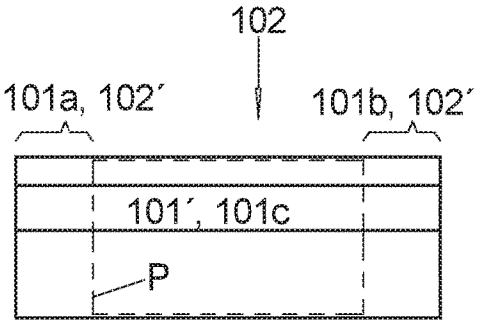
Fig. 3e1

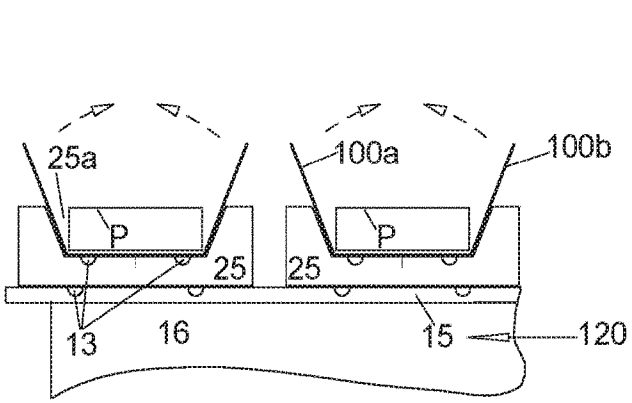
Fig. 5a2
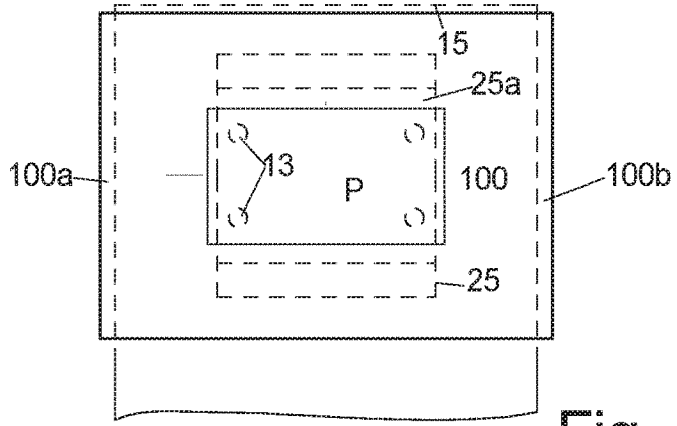
Fig. 5a1
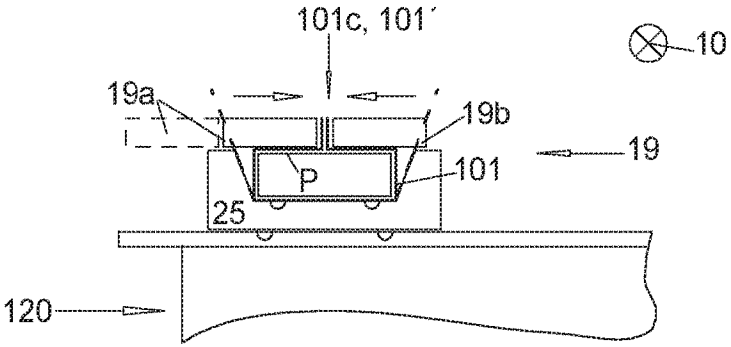
Fig. 5b2
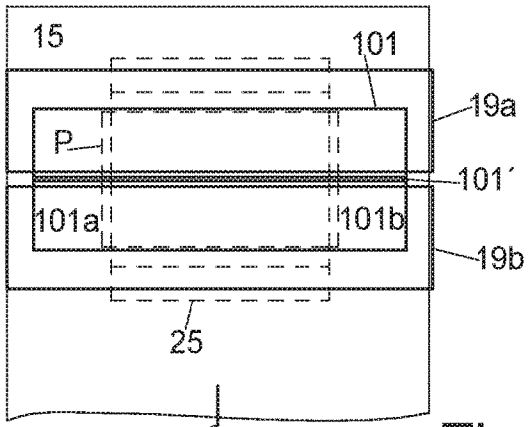
Fig. 5b1

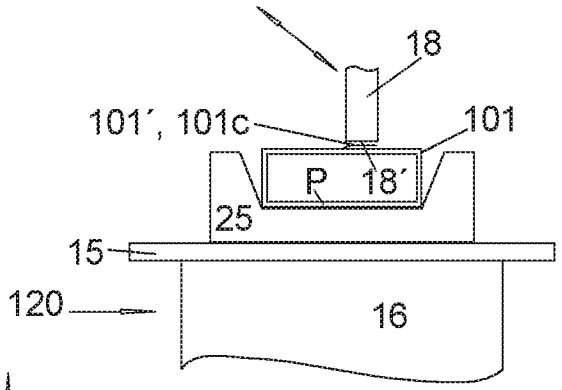
Fig. 5c2
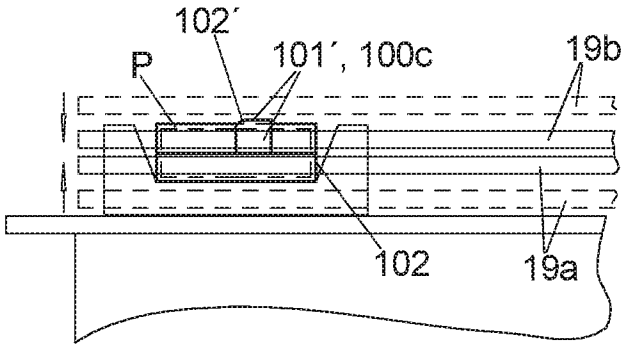
Fig. 5d2
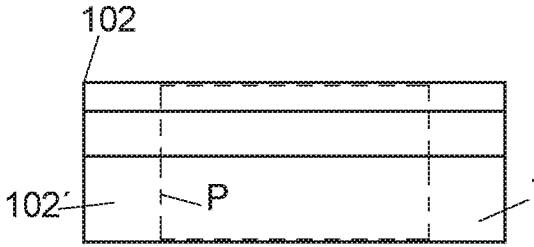
Fig. 5e1
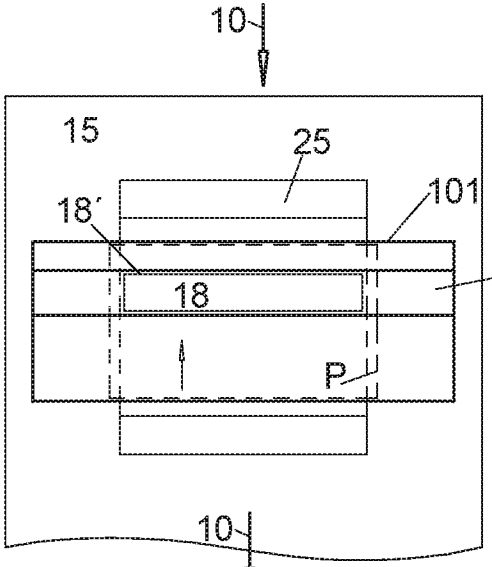
Fig. 5c1
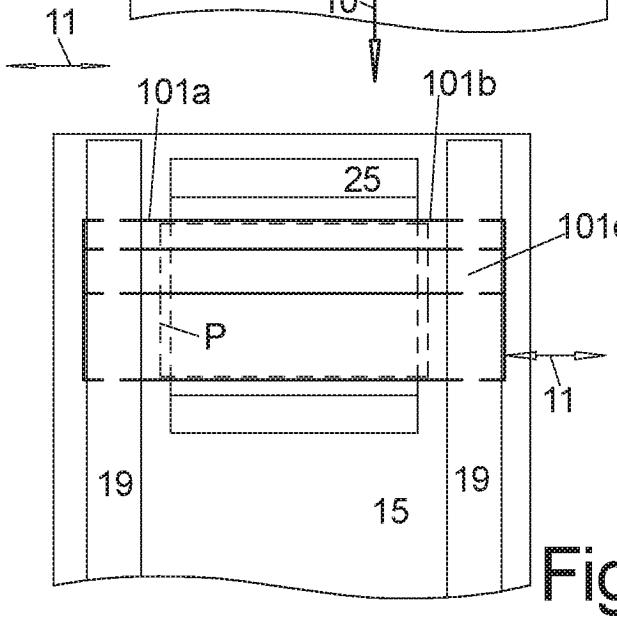
Fig. 5d1

METHOD AND MACHINE FOR PRODUCING LONGITUDINALLY AND TRANSVERSALLY SEALED FOIL BAGS FROM A NON-FORM STABLE FOIL SHEET

CROSS-REFERENCE TO RELATED APPLICATIONS

Claiming Priority to German Patent Application No. 102017121988.9

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

I. Field of the Invention

The invention relates to a method and a device for producing longitudinally and transversally sealed foil bags that are respectively filled with a product and made from a foil that is in particular flat in a starting condition.

II. Description of the Related Art

Filled foil bags of this type that are sealed all around are produced in large numbers as foil bags in a so called flow pack method.

Thus, a sequence of products to be packaged is fed in a transport direction offset behind one another and a foil web that is fed in the same direction and with the same speed is placed in the running direction about the product flow and closed by a longitudinal sealing seam that runs in the transport direction with the foil running to form a foil hose.

The foil hose that is produced according to the flow through method is divided downstream by transversal sealing seams that are offset in the running direction into individual hose bags with the foil hose running wherein the individual hose bags can be separated from each other again thereafter.

The flow pack method has the advantage that high packaging performances are achievable due to the continuous flow.

A disadvantage of the method however is the low variability of the process since all processes that are performed in the flow like foil feeding, arranging or placing the products on a transport device, producing the longitudinal sealing seam, producing the transversal sealing seam has to be performed at an identical speed.

When there are deviations here from, thus due to increasing or reducing product supply an adaptation of the subsequent processing steps is only possible in embodiments with increased engineering complexity.

One reason is that fabricating the longitudinal sealing seam is typically performed by ultrasound sealing, whereas the transversal sealing seams typically cannot be sealed by ultrasound sealing since the number of foil layers changes in the transversal direction but by hot sealing bars that are pressed against each other and heated up.

The hot sealing bars that are kept at a nominal temperature require a precisely maintained sealing time since the sealing seam can leak when the sealing time is too short and since the foil material can be melted through and damaged or destroyed when the sealing time is too long.

Since also the transversal sealing seams are produced by a flow through method and the transversal sealing is typically performed by two transversal sealing rollers that run in opposite directions and wherein the hot sealing bars are arranged on a circumference of the transversal sealing rollers the sealing time increases in an impermissible manner for a reduced pass through velocity of the foil hose and thus a reduced speed of the transversal sealing rollers.

Another disadvantage is the storage roll for the foil that has to be provided above and below the products flow wherein the storage roller causes problems in particular when it needs to be exchanged and an end of the first foil web needs to be connected with a beginning of a new foil web that is arranged on a new storage roller, and in particular causes loss of products and hose bags during the change.

On the other hand, it is well known for producing, filling and closing of packaging to move and process the packaging on a transport device in the transport direction along sequential operating stations.

When the packaging is e.g. a cardboard packaging typically a corresponding card board blank is placed to the transport arrangement and the cardboard is initially erected to form a three dimensional box that is still open at a top side e.g. in subsequently approached operating stations and thereafter the box is glued, filled with products and the open top side of the box is closed by applying a cover or folding a cover section of the box over and typically glued together.

Thus, the individual processing steps as well as the filling with products is performed at the individual processing stations by robots positioned at the transport path.

A transport device that is well known in this context includes individual transport slides that are moveable in the transport direction along a guide path independently from each other thus in particular independently from the other transport slides so that their speed is controllable and so that they can also be stopped and moved back and forth as long as this does not lead to collisions with transport slides that run further ahead on the same guide path or run further behind on the same guide path.

Movable independently from each other also means to be moveable independently from each other on the same guide path and not only moveable independently from each other at individual points of the transport arrangement but also essentially means movable independently over an entire length of the transport path, wherein collisions of the transport slides certainly have to be avoided.

Transport slides of a transport device that are movable independently from each other also means that each of the transport slides is movable at any point in time independently from the movements of the other transport slides with respect to driving direction, driving speed and also reduction of the driving speed to zero. Advantageously the transport slide can only be run forward or backward in a single transport direction.

In particular a guide path is thus arranged on a guide track that also runs in the transport direction and which thus not only carry one guide path in the transport direction but several guide paths for example one guide path on its bottom side and one guide path on its top side.

Since the guide track is made from plural modules that adjoin each other in the transport direction individual guide track modules, in particular the start module and the end module can be pivoted about a pivot axis that extends in the transport direction so that for example the previously upper guide track is subsequently arranged at a bottom side of the guide track and vice versa.

This way a transport slide that is arranged at a pivotable guide track module of this type can be pivoted from the upper guide path to the lower guide path and can be subsequently moved back along the lower guide path of the entire transport device in particular in an empty condition to the start module. It is appreciated that the transport slides have to be secured at the guide path against falling down, in particular secured through form locking.

The advantage of picking lines of this type in particular in cooperation with a transport device with transport slides that are moveable independently from each other is a high flexibility since depending on, e.g., product supply or other factors not only the speed of the transport slides during movement but also their dwelling time in the individual operating stations or similar is freely selectable.

In picking lines of this type the packaging material however has to be at least partially form stable or intrinsically stable.

III. BRIEF SUMMARY OF THE INVENTION a) Technical Object

Thus, it is an object of the invention to provide a method and a device for producing longitudinally and transversally sealed filled foil bags wherein the method has high efficiency and still facilitates a flexible production process.

b) Solution

The object is achieved by the claims. Advantageous embodiments can be derived from the dependent claims.

The object is achieved by a method wherein the foil bags are not fabricated from a running foil web, also not necessarily with the intermediary step of fabricating a foil hose, but from individual, finite foil sheets which are only formed into the foil bag by corresponding deforming and sealing of portions of the foil sheet with each other, advantageously so that the entire foil sheet is used for the foil bag and no leftover or cut off scrap remains.

For this purpose like when producing form stable packaging like e.g. cardboard packaging the non-form stable foil sheets are respectively advantageously individually received on one of several transport slides that are moveable independently from each other in a transport device, thus typically placed onto the transport slide and at least one product to be packaged is placed onto the foil sheet.

A non-stable foil sheet is defined in that supporting the foil sheet only in a center portion, in particular only below the center of gravity of the foil sheet edges of the foil sheet hang down gravity induced since the foil sheet does not have sufficient intrinsic stability in order to maintain its flat orientation.

Thus it is advantageously presumed that the foil sheet has the same stability over its entire extension, in particular along its main plane, and/or the same thickness and/or is made from the same material.

In the next step a first sealing seam is fabricated by placing two portions of the foil sheet against each other and sealing them in a first sealing step.

In another in particular next operating step a second sealing seam is generated which extends advantageously transversal to the first sealing seam and which is also advantageously generated by placing two portions of the same foil sheet against each other and sealing them, so that a filled foil bag is fabricated that is circumferentially sealed tight.

From one operating step to the next the foil sheet, typically only one foil sheet can be arranged on a transport slide, in exceptional cases also plural foil sheets is transported by the transport slide in the transport direction from one operating station to the next operating station where the individual processing steps are performed.

This way different shapes of foil bags can be produced:

A first bag shape is a hose bag.

Thus a first sealing step seals two portions at opposite edges of the foil sheet which advantageously run in the transport direction of the transport device wherein the edge portions are advantageously sealed relative to each other over their entire length.

Advantageously this can be performed in a flow through method, thus while the transport slide with the foil sheet moves in the transport direction, in particular along a corresponding typically stationary sealing unit.

In a second sealing step two opposite portions of the foil hose formed by the first sealing step are placed against each other and sealed, advantageously at each of the two ends of the foil hose, the portions of the closed circumferential hose that are arranged opposite to each other and which is thus squeezed flat in this portion.

Advantageously placing portions against each other and sealing them is performed over and entire width of the foil hose and when this is performed at both ends two second sealing seams are produced which respectively seal an end of the foil hose tight so that an overall tightly sealed foil bag is produced that is configured as a hose bag.

Typically producing the first sealing seam creates a fin in a form of two edge portions that are placed against each other and sealed so that they form the first sealing seam wherein the fin radially from in that the fin protrudes radially from the annular approximately circular closed cross section of the foil hose and an approximately radial direction.

This fin is folded to the outer circumference of the remaining foil hose before producing the second sealing seam, thus folded into one of two possible pivot directions so that the transversal sealing seam in the portion of the folded over fin is made from four foil layers when subsequently producing the second sealing seam, thus the transversal sealing seam, remote from the fin however only from two foil layers.

Thus, it is advantageously provided that the folded over fin is also welded relative to the other two foil layers when producing the second sealing seam and not only the two other foil layers are welded together in order to keep the fin permanently in the folded condition so that it contacts the circumference.

Advantageously the folded over sealing fin is in the width portion of the product that is arranged in the foil bag after producing the at least one second sealing seam, however it can also be provided to arrange the fin intentionally outside of this width portion, thus oriented away in the transport direction or in the running direction of the first sealing seam from the width portion of the product arranged therein.

Thus, folding the fin towards the remainder of the bag hose may be omitted so that the fin protrudes radially from the rest of the completely sealed bag hose also in the finished condition which facilitates producing the second sealing seam, thus the transversal sealing seam since the transversal sealing seam then only has 2 foil layers which facilitates controlling the sealing process.

The second sealing seam is advantageously fabricated not only arranged transversal, but in top view in particular perpendicular to the first sealing seam. This can be achieved for example in that the second sealing seam is produced transversal to the transport direction.

Thus, the foil sheet, in particular the foil sheet already produced can stand still in the transport direction and a sealing unit can be moved against the hose bag for producing the at least one second sealing seam, in particular in a transversal direction to the transport direction.

The other option is to produce the at least one second sealing seam so that it extends in the transport direction.

Thus, in particular the foil hose is rotated advantageously by the slide on which it is arranged so that the extension of the second seal seam to be produced is subsequently oriented in the transport direction.

According to this variant it is possible to produce the second seal seam while the foil sheet moves in the transport direction and along a sealing unit.

It is a disadvantage that the construction complexity for providing rotate ability of the foil hose in particular at the transporting transport slide is greater, however the advantage is that the entire sealing process with all sealing seams can be performed with a foil sheet or foil hose that continuously moves in the transport direction.

Namely placing portions of the foil sheet against each other and sealing them to produce the first seal seam and/or folding the seal fin can only be performed while the foil sheet moves in the transport direction using the transport slide on which it is arranged.

Folding the sealing fin is thus advantageously performed in a folding unit which includes a folding unit guide surface which folds the fin when the foil hose and thus the sealing fin moves along the transport direction through the folding unit.

The second bag embodiment is open on top:

In order to make this type of bag that is open on top initially a bag that is open at one side, is produced from the foil sheet by selecting two portions of the foil sheet that adjoin each other and are strip-shaped, in particular of the same edge portion of the foil sheet in a first sealing step as portions that are to be placed against each other and sealed, and eventually these two portions are faced against each other and sealed. Thus the two portions advantageously have half the length of the strip-shaped portion, in particular of the edge portion, which is advantageously kinked exactly in a center of its length.

When this is performed at two opposite edge portions of the foil sheet two first sealing seams are created that advantageously extend parallel to each other.

The selected strip shaped portions of the foil sheet can thus be arranged in the transport direction or transversally thereto, in particular perpendicular to the transport direction.

This produces a bag that is still open on top but in which the product is already arranged that was placed on the foil sheet already before producing the at least one first sealing seam.

Whether the produced first sealing seam then runs horizontally or vertically, thus the bag lies sideways, or stands upright advantageously also depends from a configuration and position of the product enclosed by the bag.

Namely the product is placed on the foil sheet in a manner and/or the position of the first sealing seams is provided so that the at least one first sealing seam extends laterally outside of the product in the direction in which the product does not have its smallest extension direction but in which it has its largest extension.

For a plate shaped product the first sealing seam shall extend along one or the narrow sides of the plate shape.

When a plate shaped product is placed on a narrow side onto the foil sheet both portions that are to be placed against each other and sealed are erected from the horizontal position of the foil sheet and sealed relative to each other and subsequently form a bag with two sealing seams that stand upright.

However, when a plate shaped product is arranged with one of its main surfaces flat on the foil sheet, one of the two portions that are to be sealed together is folded from the horizontal about the center of the strip shaped portion, where it is attached and folded by 180 degrees onto the other portion and sealed, so that the at least one first sealing seam thus created is arranged substantially horizontally extending.

In order to close the bag, the open side of the bag is subsequently sealed in a second sealing step in that the two portions that are arranged opposite to one another on the open side and that are to be sealed are placed against each other on both sides of the bag opening and sealed wherein the two edge portions of the bag should advantageously terminate at the same position, thus one side wall of the bag should advantageously not protrude beyond the other side wall, in particular by not more than 1 mm, better by not more than 2 mm.

Advantageously in both embodiments of foil bags to be produced the processing steps are performed at the foil sheet and/or the foil hose and/or at the foil bag while it is arranged on the slide. Only in exceptional cases the foil is removed from the foil slide for processing.

Retaining the foil sheet on the slide is advantageously performed by pulling the foil sheet against the slide by vacuum, wherein the retaining, in particular vacuum pulling, is performed during the entire processing of the foil, thus until the circumferentially sealed foil bag is produced, unless the foil is removed from the slide in between.

The sealing is either performed by hot sealing a hot seal capable foil material, which has to include at least a hot seal capable coating when the base material of the foil itself is not hot sealed capable, or by gluing.

The hot sealing can be performed by ultrasound sealing or by hot seal stamps which are heated before the sealing, advantageously also during the sealing, advantageously by electrical energy.

Thus, the sealing of sealing seams which always have the same number of layers over their entire extension, is advantageously performed by ultrasonic sealing, and/or by producing sealing seams with a changing number of foil layers along their extension is performed by hot sealing bars.

Plural foil sheets can be placed onto a transport slide adjacent to each other, in particular behind each other in the transport direction of the transport slide.

Alternatively only one foil sheet can be applied to the slide. Thus there are two options, one is to only make one foil bag from the foil sheet, thus the entire material of the foil sheet is required for producing this one foil hose.

The other option is that from this foil sheet, in particular when producing foil bags, the second sealing seams, in particular the transversal sealing seams, is performed in a larger number than required for a foil bag in the transport direction behind one another and the foil bags thus created that are still adhering to each other are separated from each other in a last operating step.

The foil sheet can extend in the condition placed on the transport slide also laterally, thus in the transport direction, of the transport slide, and/or in the transversal direction thereto over the supporting contact surface of the transport slide.

With respect to the machine for producing the longitudinally and transversally sealed filled foil bag, in particular according to the method described supra, the object is achieved in that on the one hand side a transport device with transport slides is provided which are movable independently from each other along the transport device, in particular along the guide paths of the transport device, wherein the transport slides include a retaining device for retaining at least one foil sheet arranged thereon.

Additionally the device includes plural processing stations for producing the foil bags that are arranged sequentially in the pass through direction, namely

- at least one placement station, where a non-form stable foil bag is placed as a packaging material onto a contact surface of the transport slide,
- at least one filling station for placing at least one product onto the foil sheet sitting on the transport slide,
- at least one erecting station for three-dimensional forming of the foil sheet that is essentially flat in a starting condition into a three-dimensional shape,
- at least one sealing station for tightly sealing the three-dimensionally shaped foil sheet into a tightly closed foil bag, wherein the product that is previously placed onto the foil sheet is arranged in the foil bag.

Though the foil sheet itself is not form stable, does not stable transversal to its main plane, it will sit flat on the typically flat contact surface of the transport slide. Even when the foil sheet protrudes laterally beyond the placement surface, this is still considered a flat starting condition of the foil sheet.

Thus, the erecting station has to be configured so that it is capable by forming, in particular without additional stretching of the material of the foil sheet to place portions, in particular edge portions of the foil sheet, against one another, and the sealing station has to be configured so that it is capable to seal the portions tight, in particular the portions of the same foil sheet, that are placed against each other.

Thus, the placement of the foil sheet onto the transport slide and/or the placement of the product onto the foil sheet sitting on the transport slide is advantageously performed by at least one robot.

This device facilitates producing foil bags in a variable manner, in particular foil bags that differ greatly in size and with respect material, in particular when the individual operating stations and the operating devices arranged therein are adjustable with respect to different processing parameters.

With respect to at least one transport slide the support device for supporting the applied foil sheet is at least one vacuum pump wherein the transport slide advantageously includes its own vacuum pump to generate the vacuum required for the at least one suction cup.

The contact surface of the transport slide for the foil sheet can be smaller in top view than the foil sheet that is placed onto the transport slide.

This can be used in particular to let guide elements like guide surfaces for folding portions of the foil sheet and/or a sealing apparatus engage outside of the contact surface of the transport slide at the foil sheet.

The transport slide advantageously includes a format plate that is replaceable in a simple manner, in particular replaceable without tools, in particular insertable wherein an externally accessible side of the format plate forms the contact surface.

Thus, transport plates can be inserted into the transport slide as a function of the size of the required foil sheet and/or of the product to be packaged which facilitates a quick retrofit of the device to another foil bag that is to be fabricated.

Advantageously the format plate is rotatable relative to a remainder of the transport slide, thus the base element of the transport slide, or the entire transport slide is rotatable about a pivot axes that extends transversally, in particular orthogonal to the main plane of the format plate or the contact surface of the format plate, in particular by at least 90 degrees.

Thus, the foil bag resting on the format plate or already also the foil hose or already the foil bag can be erected so that the orientation of the next sealing seam to be produced coincides with the transport direction or extends in a transversal direction thereto depending what is better for the engagement of the sealing unit.

The erecting station is advantageously arranged in the pass through direction of the device downstream of the filling station where the product is placed on the foil sheet.

In exceptional cases, for example when the foil bag is configured as a bag that is open on one side the filling station can also be arranged after the erecting station and even after the first sealing station for producing the first sealing seams, thus after fabricating the foil bag that is still open in the device.

Advantageously the erecting, thus the forming of the foil bag into a three dimensional shape is performed by guide surfaces which form an element of the erecting station wherein the guide surfaces run along the foil sheet and contact portions of the foil sheet and are shaped so that they move these portions into a desired position and also keep the portions in the desired position.

At least one sealing station, advantageously however 2 sealing stations are provided offset in the pass through direction along the transport device.

Advantageously the sealing station includes a sealing unit which is configured to produce a longitudinal sealing seam at a foil sheet that runs through the sealing unit or along the sealing unit and that is moved by the transport slide. The sealing unit is thus advantageously positioned, fixed in place at the transport device in the pass through direction but it can approach the transport slide in the pass through direction or it can move away from the transport slide.

Furthermore the sealing station can include a sealing unit which is configured to produce a transversal sealing seam that extends in a transversal direction to the pass through direction horizontally or vertically then advantageously however at the foil sheet that is stationary in the pass through direction of the sealing unit.

Also a sealing unit of this type is advantageously fixed in place in the pass through direction at the transport device but moveable in the transversal direction relative to the transport device, thus in particular the transport slide running on the transport device.

The sealing unit can be a gluing unit, however it is advantageously an ultrasonic unit or heating bar sealing unit since no additional glue is required for this purpose.

The placement station includes either a storage container in which ready cut finite foil sheets are stored and individually retrieved therefrom and placed onto the transport slides or a production unit for the foil sheets.

In a production unit of this type the foil sheets are produced as required from a storage roller that is provided in the production unit in that cut offs from the foil band that is pulled off from the storage roller are produced by a separation device in particular a cutting device.

Depending on the width of the foil band a cut off foil strip can directly have the dimensions of the desired foil sheet or a multiple of the dimensions of the required foil sheets so that the foil strip has to be cut again into several foil sheets which is also performed in the production unit.

Certainly also the reverse method is possible namely to cut the foil band that is pulled off from the storage roller in the pull off direction into plural narrower foil bands that are arranged adjacent to each other which respectively have a width of a required foil sheet and to cut sections from these individual foil bands which correspond to the length of the desired foil sheet.

This way individualizing of foil sheets that are stacked on top of each other in a storage container is prevented which can otherwise cause problems due to static charges being generated.

With respect to an optionally provided rearrangement station for re arranging finished foil bags into an enveloping packaging the rearrangement station can advantageously include another transport device for the enveloping packaging in particular cardboard boxes which transport direction is advantageously parallel to an advantageously opposite to the transport direction for the foil sheets and the foil bags created therefrom, wherein the two transport devices are controllable and drivable independently.

The device typically includes a machine frame which carries the described components thus the one or the two transport devices and the individual processing stations and processing units and optionally the robots performing the rearrangement processes.

It is evident that producing the desired foil bags can be performed in a very flexible manner by this device, thus foil bags that differ with respect to size and material can be produced and different products can be packaged therein.

BRIEF DESCRIPTION OF THE SEVERAL VIEWS OF THE DRAWING(S)

Figure 1B:
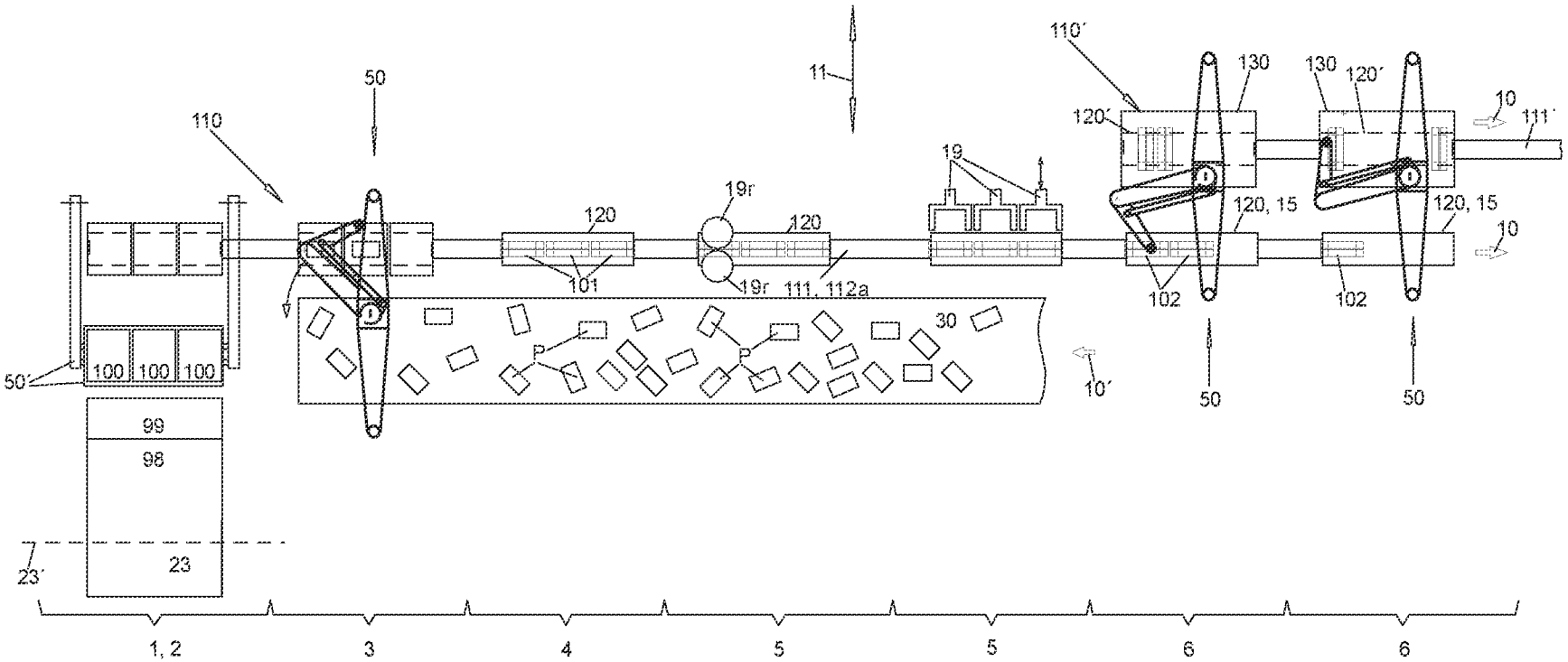
Figure 1C:
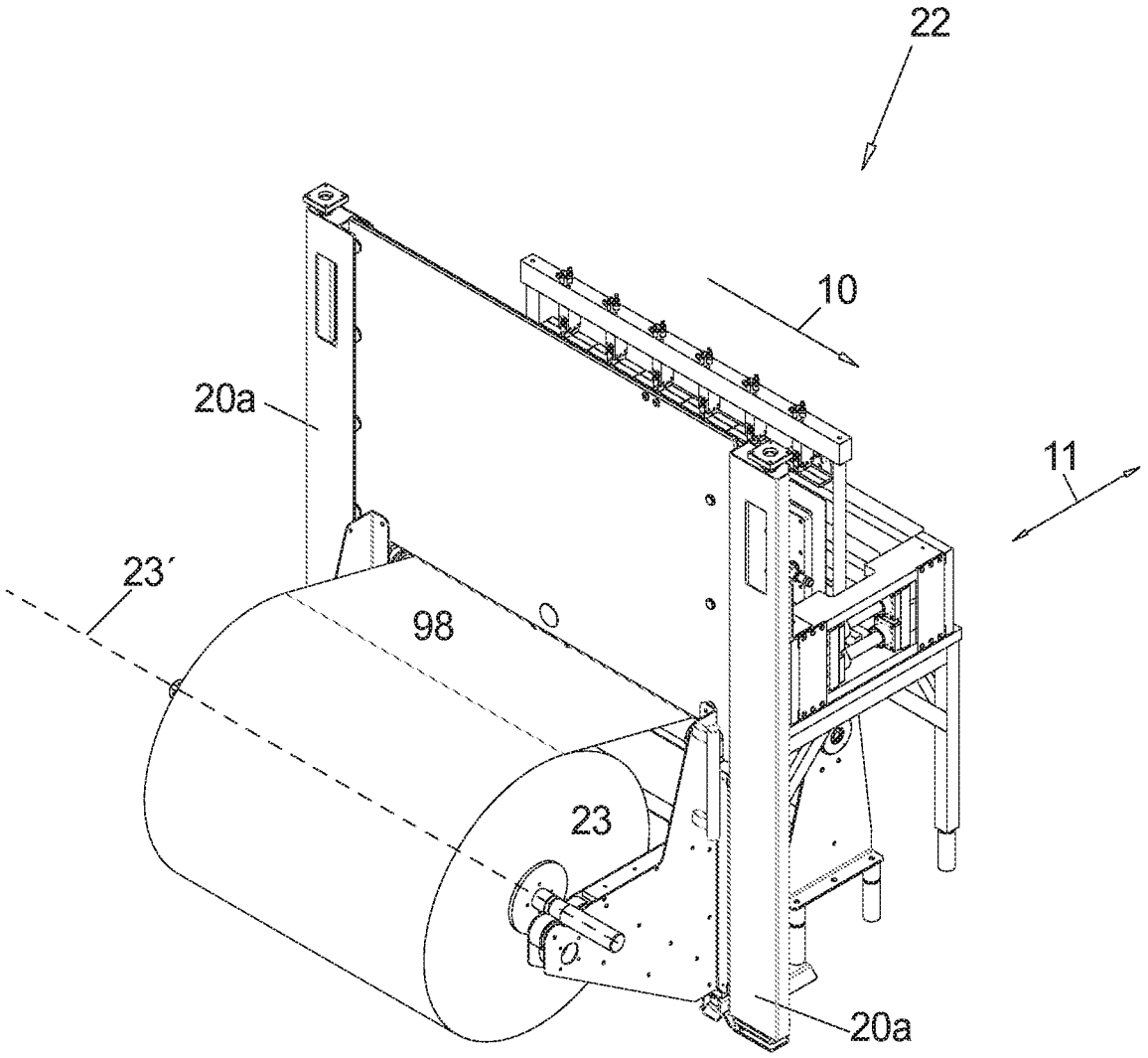

Embodiments of the invention are subsequently described in more detail, wherein:

FIG. 1*a* illustrates a machine for producing the foil bags in top view, however without robot;

FIG. 1*b* illustrates the machine without machine frame in top view;

FIG. 1*c* illustrates the sheet production unit of the machine in a perspective view;

FIGS. 2*a*1-2*e*1 illustrate a first fabrication process for the foil sheet in top view and in the pass through direction;

FIGS. 3*c*1-3*e*1 illustrate a portion of a second production process for foil sheets with analog figure designations;

FIGS. 4*a*-4*d* illustrate the transport device of the machine of the present invention in different views; and FIGS. 5*a*1-5*e*1 illustrate a third production process for the foil bags in top view and the pass through view.

DETAILED DESCRIPTION OF THE INVENTION

FIG. 1*a* and FIG. 1*b* illustrate the machine for producing foil sheets in top view.

Thus this top view shows a product band 30 in a product feed device 10' on which the unorganized products P are fed and the transport device 110 which initially transports the foil sheets 100 and the hose bags 102 that are created there from downstream in the pass through direction 10 through the machine in a parallel arrangement.

The pass through direction 10 for the foil sheets is oriented from left to right in FIGS. 1*a, b*.

FIG. 1*a* illustrates the machine including the machine frame 20 that supports all components of the machine wherein the machine frame includes plural frame modules 20.1, 20.2 which are arranged in the pass through direction 10 behind one another and which are rectangular in top view and which are typically aligned with one another but which can also be offset from each other as evident from FIG. 1*a* between the last sealing station 5 and the first rearrangement station 6 as will be described infra.

Each of these frame modules 20.1 is made from vertical frame columns 20*a* in corners of the frame module 20.1, 20.2 that is rectangular in top view wherein the vertical frame columns are not visible in FIG. 1*a* and only illustrated in FIG. 1*c* and which are connected by longitudinal beams 20*b* extending in the pass through direction 10, the longitudinal direction of the machine and transversally extending transversal beams 20*a* in their upper end portion.

In order to prevent access to an interior of the machine during operations of the machine free spaces between the upright frame columns 20*a* are closed along the longitudinal sides of the machine frame 20 by safety doors 7 which trigger an alarm signal or shut the machine down when they are opened while the machine is operating.

The individual frame modules 20.1 are connected with one another mechanically in particular bolted together and also connected to transfer data and energy between each other.

Thus, the transport device 110 for the foil bag production, in particular for the hose bag production extends in the machine in the pass through direction 10 in the beginning of the first frame module 20.1 to the last frame module and optionally beyond whereas the product band 30 that is visible in FIG. 1*a* below and comes in from the right terminates in the second frame module 20.2 from the left, thus in the pass through direction 10.

Namely in the first frame module 20.1 that is in the very left in FIG. 1*a* on the one hand side a sheet station 1 is provided configured as a sheet production unit 22 for producing the foil sheets 100 from a foil web that is wound onto a storage roller 23 and on the other hand side a placement station 2 for applying the foil sheets 100 to a transport slide 120 of the transport device 110.

Thus, the storage roller 23 is attached at the frame module 20.1 however on its outside that is illustrated at a bottom in FIG. 1*a* which is primarily used for switching the storage roller 23 more easily when it is outside of the frame module 20.1.

A storage roller unit with the storage roller 23 arranged therein is illustrated separately in FIG. 1*c*, wherein also 2 vertically oriented frame columns 20*a* of the frame module 20.1 are visible at which the storage roller unit and thus also the storage roller is attached.

From this storage roller 23 whose axis direction 23' extends parallel to the longitudinal direction 10 of the machine, the pass through direction 10, the foil web 98 wound thereon is pulled off in the transversal direction 11 and thus into an interior of the frame module 20.1 and there initially cut off from the foil web 98 by the cutting devices 24 indicated in FIG. 1*a* initially by a cut parallel to the axis orientation 23' of the storage roller 23 into strips 99 which are subsequently divided into individual foil sheets 100 that are offset in the axis direction 23' by cutting or punching in the pull off direction. This is the sheet station 1.

These foil sheets 100 are gripped by a robot 50' that is indicated in FIG. 1*a* only by arrows and illustrated in FIG. 1*b* wherein the robot only has to have two degrees of freedom and the foil sheets are transferred in the transversal direction 11 within the first frame module 20.1 of the machine onto a transport slide 120 of the transport device 110 which certainly has to be positioned for this purpose in the pass through direction 10 at a corresponding location of the transport device 110. This forms the placement station 2.

A transport slide 120 of this type that is loaded with typically plural foil sheets 100 that are arranged in sequence in the pass through direction 10 is moved in the past through direction 10 typically into a filling station 3 that is arranged in the next frame module 20.2 but which can also be distributed over plural frame modules 20.2 and wherein one or plural products P are picked up from product conveyor 30 by one or plural robots 50 which are suspended over the transport device 110, and the product band 30, which are only indicated in FIG. 1*a* for reasons of clarity and illustrated in FIG. 1*b* and which are placed in a correct rotation position and positioned on each of the foil sheets 100.

The transport slide 120 with the filled foil sheets 100 placed thereon is transported forward to an erecting station 4, thereafter to a first sealing station 5 for producing a longitudinal sealing seam 101', then further to another sealing station 5 for producing a transversal sealing seam 102', which are typically respectively arranged in a proprietary frame module 20.3 through 20.5.

In a displacement station 6 that adjoins in a pass through direction 10 which uses two additional frame modules 20.6, 20.7, in this case, an additional transport arrangement 110' commences which is advantageously configured analogous to the transport arrangement 110 with respect to slides 120' that are movable independently from each other and the transport direction 10 and wherein the additional transport device 110' extends further to the right from the displacement station 6.

On this second transport arrangement 110' that extends parallel to the first transport arrangement 110 enveloping packaging, in particular cardboard boxes 130 are arranged on the individual transport slides 120' which are fabricated in the first of the two frame modules 20.6 in the pass through direction 10 initially by one of the indicated erecting devices from flat cardboard blanks and placed on the transport device 110'.

Additional robots 50 that are arranged in the pass through direction 10 behind one another grip the finished hose bags 102 which rest on the slides 120 of the first transport device 110 and displace into the enveloping packaging 130 on the slides 120' of the other additional transport device 120' and transport it away by the additional transport device 110' for further handling, in particular beyond the end of the last frame module 20.7, to a non-illustrated further remote separate station, thus a palletizing station.

Transversally to the pass through direction 10 the frame modules 20.6, 20.7, with the additional transport device 111' are offset relative to the frame modules 20.1 through 20.5 that are upstream and the pass through direction 10 so that the first transport device 111 extends through all frame modules 20.1 through 20.7, however, the product band 30 that is arranged opposite to the additional transport device 111' with respect to the first transport device 111 extends next to the frame modules 20.6, 20.7, with the additional transport device 111' arranged therein.

The process of producing the fall bags 102 from a respective foil sheet 100 with a product P placed thereon in the erecting station 4 and the sealing stations 5 is illustrated with reference to a single foil sheet 100 in FIGS. 2 and 3, wherein FIGS. 2*a*1, 2*b*1, 2*c*1, 2*d*1, 2*e*1 illustrate the situation in a top view and FIGS. 2*a*2, 2*b*2, 2*c*2 and 2*d*2 that are provided with parallel numbering illustrate the respective same situation viewed in the pass through direction 10.

Only for FIG. 2*e*1 which illustrates the finished hose bag 102 in top view there is no additional analog representation viewed in the pass through direction 10 since this view of the finished hose bag 102 is already evident in FIG. 2*d*2.

FIG. 2 illustrate a first process.

FIG. 3 illustrate a portion of a slightly different second process with respect to the conditions C, D and E, wherein FIGS. 3*c*1, 3*d*1, 3*e*1 illustrate a representation in a top view of the machine, and the analog numbered FIGS. 3*c*2 and 3*d*2 illustrate the same production step viewed in the pass through direction 10, wherein FIG. 3*e*1 in turn does not include any analogous representation viewed in the pass through direction 10 since this condition of the hose bag 102 is already evident in FIG. 3*d*2.

First process: Initially the foil sheets are provided and one or plural foil sheets are placed on a slide 120.

In the filling station 3 the product P which is cuboid is placed on a foil sheet 100 according to FIG. 2*a*1 so that the foil sheet protrudes in top view on all sides beyond the product P. In top view the product P is arranged in the pass through direction 10 with its largest extension.

Advantageously as also evident from FIG. 1 *a, b*, plural foil sheets 100 are placed behind one another in the transport direction 10 on the transport slide 120, thus its format plate 15.

Thus the foil sheet 100 has to be sized relative to the product P so that

- it has a greater extension in the transversal direction 11, thus width than the circumference of the product in this direction, and
- it is longer in the longitudinal direction 10 than the product P in the pass through direction 10 in addition to the height of the product P in this direction.

As illustrated in FIG. 2*a*2 the foil sheet 100 is wider in the transversal direction 11 than the format plate 15 of the slide 120 on whose surface the foil sheet 100 is supported by vacuum loaded suction cups 13.

Subsequently the edges or edge portions 100*a, b* of the foil sheet 100 that advantageously extend in the pass through direction 10 are gripped according to the arrows drawn in FIG. 2*a*2 and placed against each other above the product P, advantageously over its center in the transversal direction 11 so that the product P is enveloped by the foil sheet 100 in this longitudinal direction, the pass through direction 10 and the edge portions 100*a, b* that are placed against each other form a fin 101 *c* that protrudes upward from a top side of the product P wherein two initially separate foil layers of the fin are sealed relative to each other according to FIG. 2*b*1, 2*b*2 to form a longitudinal sealing seam 101' that extends on the longitudinal direction 10.

For this purpose sealing bars 19*a, b* of a sealing unit 19 that are approached in the transversal direction 11 engage for this purpose on both sides of the fin 101*c* which still has 2 layers initially and press the two layers of the fin 101*c* against each other and weld them together due to the temperature of the sealing bars 19*a, b*. This can also be performed in a flow through process in that the sealing bars 19*a, b* are sealing rollers 19*r* as evident in FIG. 2*b*1 in top view wherein roller axes 19' that are arranged in the vertical 12 are advantageously already preloaded against each other and driven to rotate and thus weld the 2 layer fin 101*c* inserted there between which can only be performed by moving the slide 120 forward in the pass through direction 10 so that the sealing rollers 19*a, b* can be fixed in position.

Thus, a foil hose 101 is formed which is still open at a forward and rear face in the pass through direction 10. In order to close the foil hose initially the fin 101 is folded down from the vertical position onto the portion of the outer circumference of the foil hose which is stabilized by the product P that is typically rather closely enveloped therein as illustrated in FIG. 2*c* in the arrow direction.

This is possible in a simple manner by corresponding positioning of a fixed accordingly configured guide surface 18 and running the foil hose 101 with the fin 101*c* along the guide surface 18 which can be arranged at a corresponding position fixed in place in the machine frame as illustrated in FIGS. 2*c*1 and 2*c*2, as illustrated in FIGS. 2*c*1 and 2*c*2.

After the fin 101*c* is folded down into the vertical position thus typically in the portion of the enveloped product P on its top side and additionally protruding beyond its top side with the forward and rear overhang of the foil hose 101 in and against the pass through direction 10 beyond the product P this overhang is closed in the transversal direction 11 by producing a transversal sealing seam 102'.

For this purpose the forward and rear overhang of the product are vertically pressed together in the pass through direction 10 in front of and behind the product, advantageously by the sealing unit 19 that is approximately fork shaped in FIG. 2*d*1 in top view by two sealing bars 19*a, b* that are moveable towards each other in the vertical direction in order to form a transversal sealing seam 102' that extends approximately at a level of the product P in front of and behind the transversal sealing seam that extends in the transversal direction 11.

For this purpose the lower sealing bar 19*a* moves in the transversal direction under the overhang by which the foil hose 101 protrudes in and against the longitudinal direction 10 beyond the product and thus advantageously lifts the lower section of the overhand approximately to half the height of the product P while the upper sealing bar 19*b* is arranged with its bottom side at a level above the product P and of the foil hose 101.

Since the foil hose 101 is arranged with its overhang completely between the two sealing bars 19*a, b* the elevation moveable upper sealing bar 19*b* lowers onto the lower sealing bar 19*a* until the two layers of the overhang of the foil hoses 101 are pressed together and welded together by the sealing bars 19*a, b* to form the transversal sealing seam 102'.

Thus, for this purpose the fork shaped sealing tool 19 is displaceable in the transversal direction 11 so that it can be moved on the one hand side out of the movement path of the foil hose 101 into a deactivated position and on the other hand side for a foil hose 101 positioned as the corresponding longitudinal position close enough to this foil hose so that the overhang of the foil hose 101 is respectively arranged between the sealing bars 19*a, b* of one of the prongs of the fork shaped sealing tool 19.

Since both prongs of the fork shaped sealing tool 19 according to FIG. 2*d*1 whose clear distance in the longitudinal direction 10 is slightly greater than a length of the product P in this direction are made from a pair of sealing bars 19*a, b* of this type both overhangs of the foil hose 101 are transversally sealed in a single process step.

Thus, the finished foil bag is created that is closed on all sides as evident from the top view in FIG. 2*e*1 and as evident already from FIG. 2*d*2 looking in the longitudinal direction 10.

FIG. 3 partially illustrate a slightly different FIGS. 2*a*1-2*c*2 up to the condition illustrated in FIGS. 3*c*1, 3*c*2.

Thereafter however the foil hose 101 with the product P arranged therein is rotated about a vertical axis 12' by 90° so that the foil hose 101 extends in the transversal direction 11.

This is possible in that at least the format plate 15 on which the foil sheet 100 is initially arranged and on which the foil hose 101 produced therefrom is arranged is rotatable about the vertical axis 12' relative to the base element 16 of the transport slide 120 which is only possible either when only foil sheet 100 is arranged on the format plate 15.

When several foil sheets 100 were on the transport slide 120 thus its format plate 15 initially one foil sheet after the other in the pass through direction 10. One option is that the format plate 15 is divided into plural plate sections in the pass through direction 10 wherein the plate sections respectively carry a foil sheet 100 and which are respectively individually rotatable about a vertical axis 12' relative to the base element 16 of the transport slide 120.

Thus, the overhangs 101*a, b* of the foil hose 101 protrude on both sides beyond the product in the transversal direction 11.

This facilitates producing the transversal sealing seams 102' during the pass through of the foil hose 101 in the transport direction 10 in that sealing rollers 19*r* are arranged fixed in place above and below the foil hose 101 e.g. below and above the transversal sealing seam 102' to be created in the transversal portion of the respective overhang 101*a*, 101*b* as illustrated in FIG. 3*d*2 on the right side wherein the sealing rollers rotate about rotation axes 19' that extend horizontally in the transversal direction 11.

The sealing rollers are in turn arranged at a horizontal distance from each other or even preloaded against each other so that the overhand 101*a*, 101*b* extending there between is compressed to form the transversal sealing seam 102' and sealed. For this purpose the transport slide 12 does not have to be stopped.

Certainly also a stationary production of the transversal sealing seam 102' is possible, thus with a stopped transport slide 12 where two sealing bars 19*a, b* that approach each other from above and below and that do not rotate receive the overhand 102 *a, b* between each other and welded together as illustrated in the left half of FIG. 3*d*2.

In both cases a finished hose bag 102 is produced as illustrated in FIG. 3*e*1 in top view and as evident in FIG. 3*d*2 already in pass through direction 10.

In this context reference shall be made that the transversal sealing seam has four layers for both method in the portion of the folded over fin of the longitudinal sealing seam and otherwise it only has 2 layers. Thus the transversal sealing seam 102' is advantageously produced by heat sealing bars and not by ultrasound sealing bars.

The subsequent handling of the finished hose bags 102 which are still arranged on the slide 120 of the transport device 111 is illustrated in turn in FIGS. 1*a, b*.

Downstream of the last sealing station 5 where the last sealing seam, typically the transversal sealing seam 102 is produced two rearrangement stations 6 adjoin in this case in which the finished hose bags 102 are rearranged from the transport slides 120 of the first transport device 110 into enveloping packaging 130 typically cardboard boxes which are fed on another transport device 110 and transported away wherein there transport direction 10 is parallel to the first transport direction 110 possibly opposite to the first transport direction 110.

The rearranging is performed by one or plural additional robots which are arranged above the two transport devices 110, 110' as evident in FIG. 1*b*. Since the additional transport device 110' is arranged on a side of the first transport device 110 which is opposite from the product band 30 the frame modules 20.6, 20.7 in which the additional transport device 110' is already provided is arranged offset in a transversal direction 11 from the frame modules 20.1-20.5 in order to be able to attach both transport devices 110, 110' therein.

Thus, the cardboard boxes 130 can be arranged in turn on slides 120' that are moveable independently from each other along a track element 111', thus the basic configuration of the two transport devices 110, 110' can be the same or the cardboard boxes 130 are placed on a conveyor belt on which they are fed and transported away after filling.

The transport device 110, 110' is illustrated in detail separately in FIGS. 4*a-d*.

The transport device 110 is made on the one hand from a track element 111 on which a respective guide path 112*a*, 112*b* is formed on two sides that are arranged opposite to each other wherein transport slides 120 are moveable along the guide path and thus along each guide path 112*a* or 112*b* independently from each other so that the transport slides 120 running on the same guide path and also on the different guide paths 112*a*, 112 *b* can have velocities and even driving directions that differ from each and independent from each other so that they can be stopped independent from the other transport slides.

Figure 4A:
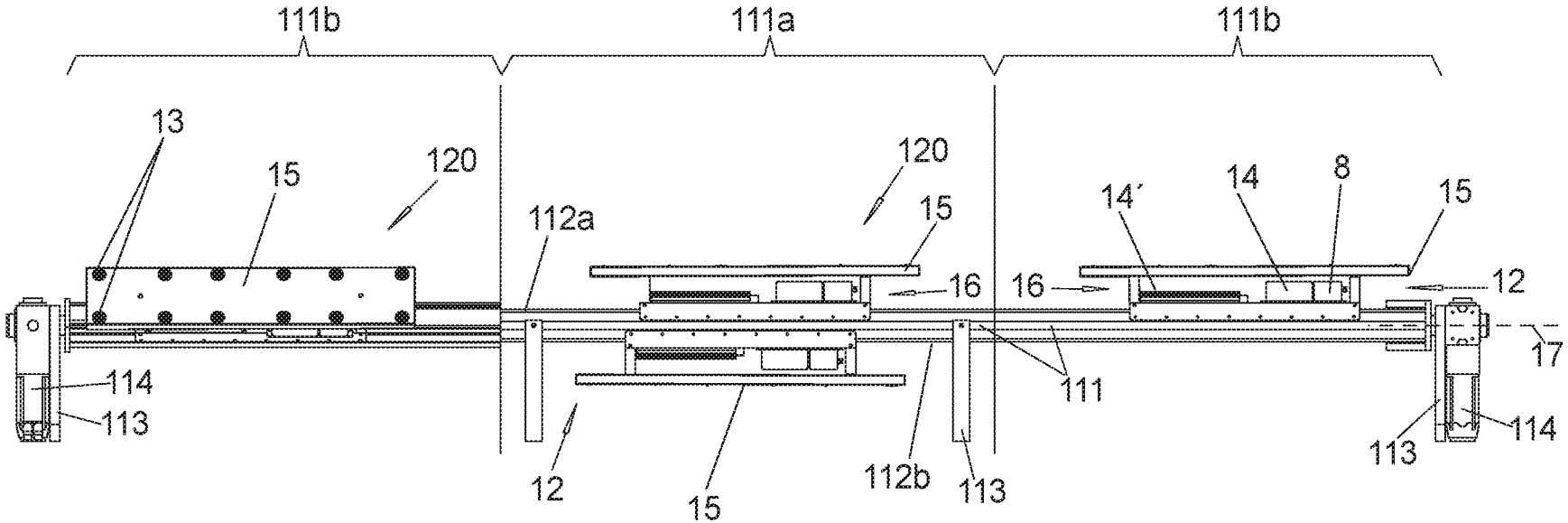
Figure 4B:
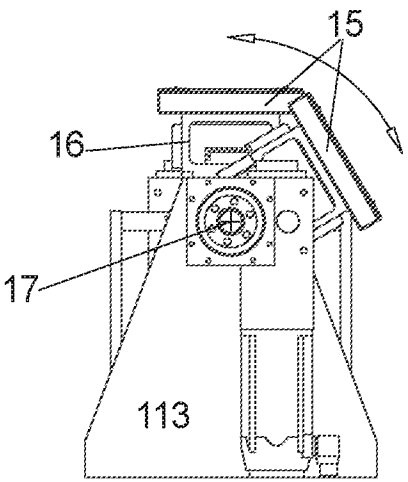
Figure 4C:
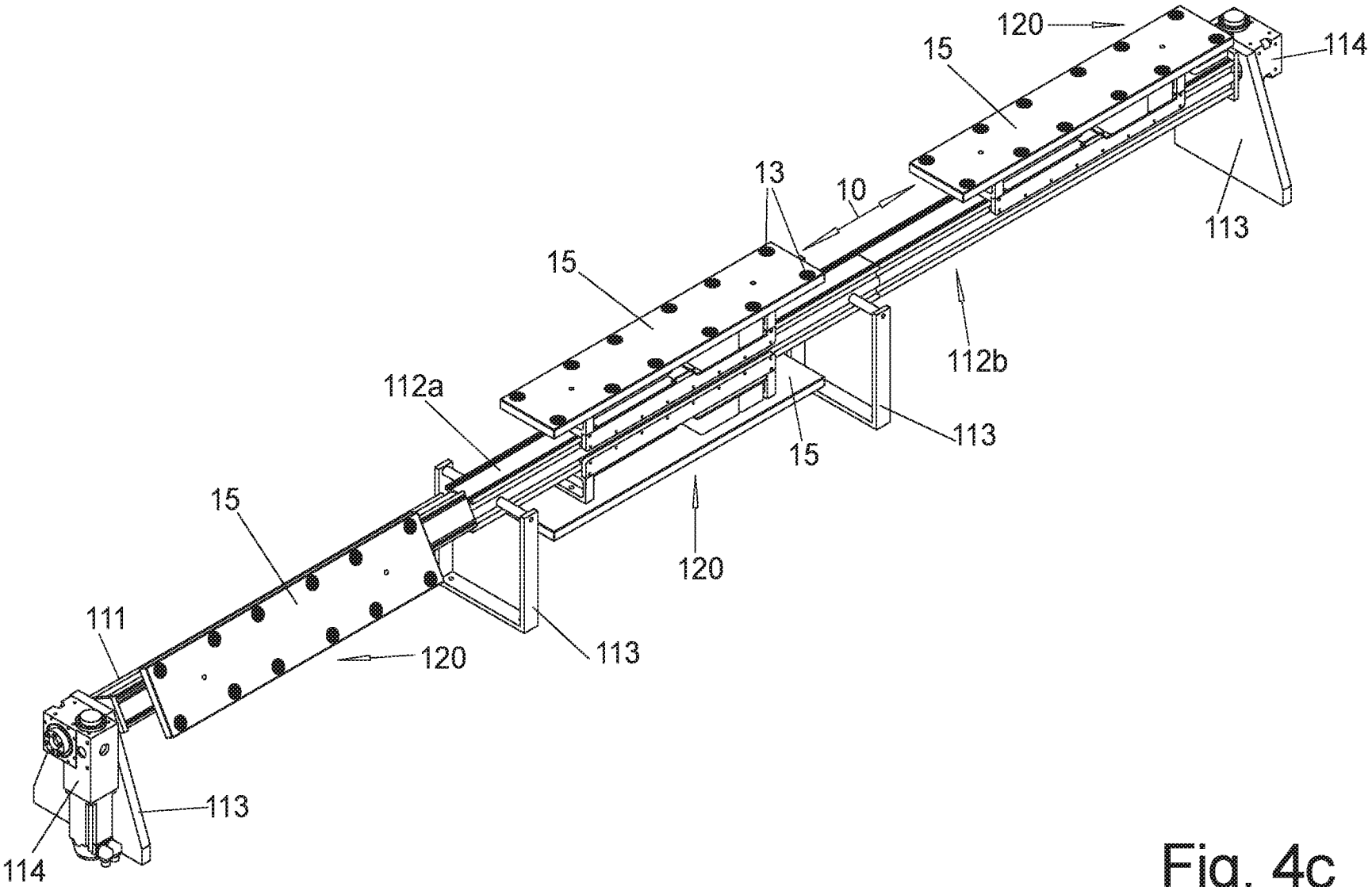
Figure 4D:
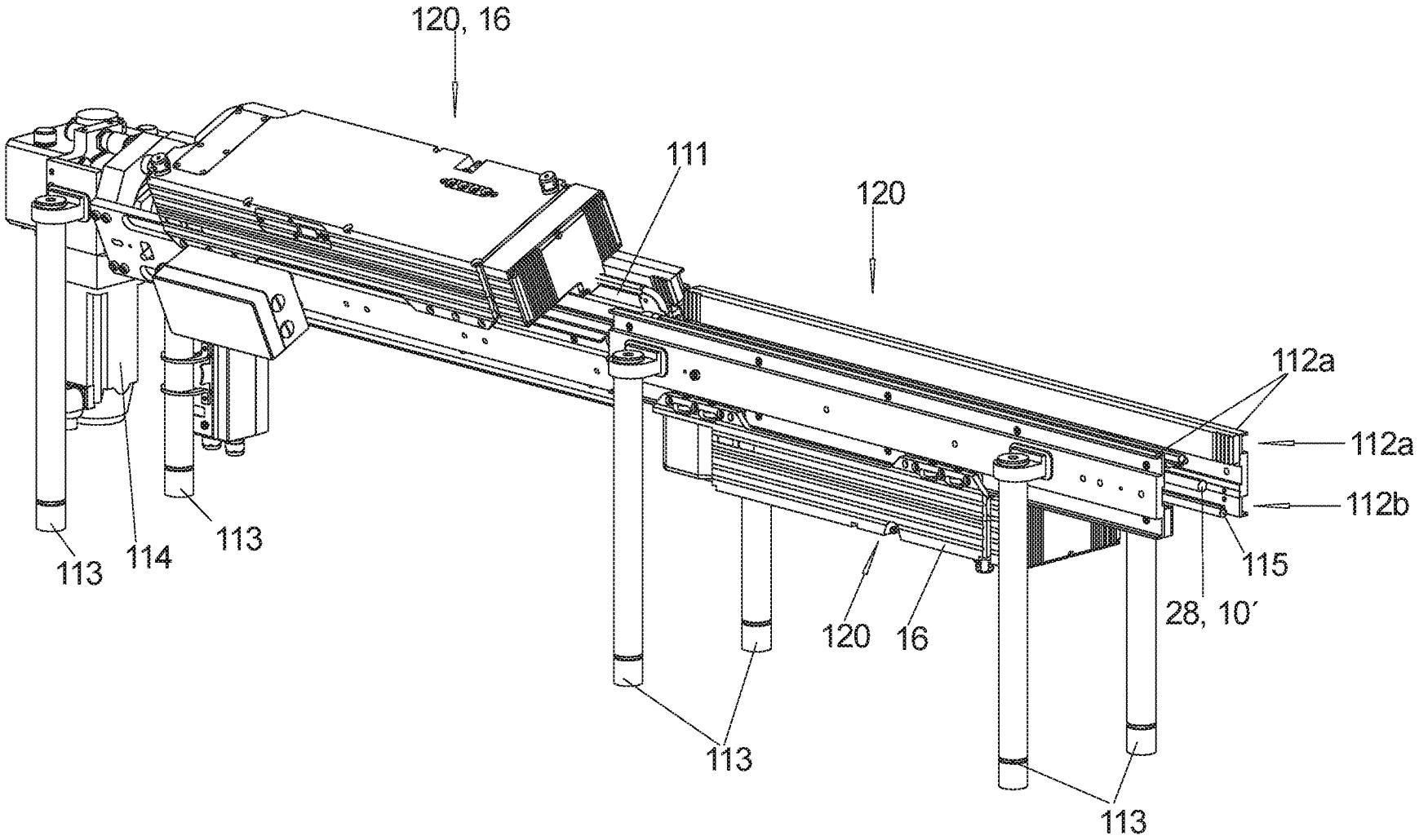

As illustrated already in FIGS. 2 and 3 and evident best in FIG. 4*a* center in the right portion a transport slide 120 is respectively made from a base element 16 that is moved along the guide path 112*a* or 112*b* and on which a format plate 15 is arranged on a side that is oriented away from the guide path wherein the format plate is adapted to the respective transport task with respect to size and configuration.

In the illustrated case the format plate 15 according to FIGS. 1*a* and 1*b* has a length in the transport direction 10 so that 3 foil sheets 100 can be applied thereto sequentially and the format plate 15 is provided with vacuum loadable suction cups 13 at its top side wherein the suction cups are positioned so that not only the flat foil sheet 100 is retained at the format plate 15 but also the hose bag 102 which has a much smaller base surface than the original foil sheet 100.

An additional particularity of the transport device 110 is that the track element that is made from individual modules that are arranged behind one another in the transport direction 10 without gaps does not only include one but typically plural fixed track element modules 111*a* whose track element 111 is permanently mounted but in particular includes a reversal module 111*b* as a first module and a last module of the transport device in the transport direction 10 wherein the track element 111 of the module extends about a pivot axis 17 that extends in the transport direction 10 and can be pivoted by at least 180° so that the previously upper guide path 112*a* is aligned thereafter, thus after the pivoting by 180° with the lower guide path 112 *b* of the adjacent fixed track element module 111*a*.

Since the transport slides 120, in particular their base elements 16 are also supported in the vertical 12 at the respective guide path 112*a*, 112*b* so they cannot be lost. A slide 12 that is initially arranged at a top side of the track element 11 can be displaced by pivoting to a bottom side and can then be moved back at the lower guide path 112*b*, for example in an empty condition to the starting point of the transport path and rotated upward by the other reversal module 111*b*, reloaded so that it can be used for transporting foil sheets 100 or products P.

In FIGS. 4*a*-4*d*, the track element modules 111*a, b*, thus the entire track element is illustrated on supports 113.

When installed in a machine as illustrated in FIG. 1*a* the track element 111 and thus the entire transport arrangement 110 is certainly connected with the base frame 20 of the machine, however in turn so that rotate ability of the track element modules in the reversal modules 111*b* also with transport slides 120 attached thereto is possible without collision with other components of the machine, in particular its base frame 20 like the moving of the transport slides with applied foil sheets 100 or products P is possible along the entire transport path P.

The pivotable track element modules in the reversal modules 112*b* are pivoted by a controlled pivot motor 114.

Since the transport slides 120 shall be moved independently from each other a drive is arranged on the one hand side in the base element 16 of the respective slide 120 and configured as a drive motor 8 which can for example drive a sprocket that is rotatably supported in the base element 16 which meshes with a gear rack that is arranged in the track element 111 in the transport direction 10 and not illustrated.

Since the suction cups 13 require a vacuum supply a vacuum pump 14 is advantageously provided in each base element 16 and a vacuum container 14' from which the suction cups 13 are loaded with vacuum while the vacuum pump 14 maintains the vacuum in the vacuum container 14'.

The individual slides 120 are supplied with electric energy for the drive motor 8 and for the vacuum pump 18 wherein they receive electrical energy advantageously touch free for example by induction from a current conductor 115 that extends in a center of the track element 111, in the transport direction 10.

Furthermore FIG. 5, thus FIGS. 5*a*1-5*e*1 show a third process in analogy to the designation and arrangements of FIGS. 2*a*1-2*e*1, wherein subsequently also primarily the differences to the first process according to FIGS. 2*a*1-2*e*1 are described:

A first difference is that according to FIG. 5*a*1 and following the product P is not applied in top view with its greatest extension in the pass through direction 10, the transport direction of the foil sheets 100 through the machine as illustrated in FIGS. 2*a*1-2*e*1, but with its largest extension transversal to the pass through direction 10.

Since the longitudinal sealing seam 101 is typically produced for a hose bag 102 so that it extends in a direction of the largest extension of the product P to be packaged, as subsequently described the transversal sealing seam 101' is also fabricated transversal to the pass through direction 10. However it shall be emphasized that this is no mandatory rule and in all described production processes the longitudinal sealing seam 101' can also be arranged in a direction of the smaller extension of the product P in the top view.

The second apparent difference of FIG. 5 over FIG. 2 is that the individual foil sheets 100 at a beginning of the process are not placed directly on a front plate 15 with a flat top side but respectively in a groove shaped recess 25*a*, thus configured in a top side of a format tub 25 that is separate for each foil sheet 100.

The annular recess 25*a* that is open on both sides thus extends like the direction of the largest extension of the product P also transversal to the pass through direction 10, thus in the horizontal transversal direction 10 so that the format tub 25 represents a portion of the profile. Thus a length of the format tube 25 that is measured in the transversal direction 11 and thus of the groove shaped recess 25*a* has at the most the same length as the product P measured in the transversal direction 11, advantageously as illustrated it is slightly shorter so that the product P protrudes on both sides slightly beyond the groove shaped recess 25*a*.

Thus the groove shaped recess 25*a* has sloped flanks which diverge from a base to an upper end of the groove 25*a* and which have an upward increasing distance from each other.

The depth of the grooves 25*a* thus has a maximum size that is as big as the height of the product P to be inserted, advantageously slightly less so that the seal bars 19*a, b* can be moved over the edges of the grooves 25*a*, thus the format tub 25 slightly above the product.

In the base of the groove shaped recess 25*a* there are advantageously vacuum loaded suction cups 13 in order to pull the foil sheet 100 towards the base of the groove 25*a* wherein the foil sheet 100 is initially flat or already sags in downward direction and which is approached from above, wherein the foil sheet 100 already assumes an approximately U-shaped contour in the transversal direction before applying the product P to the foil sheet 100 in the groove 25*a*, which facilitates handling the foil sheet 100 thus deformed.

It is also evident from FIG. 5*a*2 that the format tubs 25 are configured individually for each foil sheet 100 and sit in this case not directly on the base element 16 of the slide 120 but on a format plate 15 placed thereon and are retained themselves in turn in position by suction cups 13.

Thus neither the support device in the form of suction cups 13 is mandatory between the format plate 15 and the format tub 25 as well as between the foil sheet 100 and the groove 25*a* but other support devices can also be for this purpose.

Furthermore the format plate 15 as well as the format tubs 25 resting thereon can be configured functionally united, in particular integrally in one piece as a format plate in which the plural groove shaped recesses 25*a* are fabricated in a top side since plural foil sheets 100 shall be placed on a slide 120 advantageously in the pass through direction 10 and fabricated into foil bags.

Using the groove shaped recesses 25 *a* is not tied to the placement direction of the product P in its largest extension in the transversal direction either but could also be used for the process according to FIG. 2, wherein the extension direction of the groove shaped recess 25, thus the profile direction would be in the pass through direction 10.

Since a product P rests in each groove 25*a* and on the foil sheet 100 the longitudinal sealing seam 101' is fabricated according to FIG. 5*b*2 in that two bar shaped sealing bars 19*a, b* with sealing surfaces that extend in the transversal direction 11 are arranged slightly above the product P wherein one is approached in the pass through direction 10 and the other is approached against the pass through direction 10 until they clamp and seal the upward protruding edge portions 100*a, b* of the foil 100 between each other so that they produce the longitudinal sealing seam 101' which forms a fin 101*c* that extends in finished condition in the transversal direction 11 and protrudes in the upward direction.

Thereafter the sealing bars 19*a, b* are offset from each other again into their starting position in which they have a greater distance from each other than the upward protruding edge portions 100*a, b* of the not yet sealed foil sheet 100.

The foil hose 101 thus created still rests in the groove shaped recess 25*a* of the format tub 25 as evident from FIG. 5*b*1 with the sealing bars 19*a, b* still in the sealing position and as illustrated in FIG. 5*c*1 for reasons of clarity already without the sealing bars, however it protrudes on both sides beyond the groove 25*a* with the overhang 101*a, b* as illustrated in FIG. 5*b*1.

In order to close these overhangs 101*a, b* of the foil hose 101 in the pass through direction 10 on both sides by the transversal sealing seams 102' the upward protruding fin 101*c* of the longitudinal sealing seam 101' is folded to the top side of the foil hose 101, in this case against the pass through direction 10 in that a bar shaped folding device 18 that extends in the transversal direction 11 is run slightly above the top side of the foil hose 101 against the fin 101*c* so that the fin is folded over, wherein the folded device 18 whose bottom side forms the active guide surface 18' remains in the folded over position of the fin 101*c* in contact therewith as illustrated in FIG. 5*c*2 until producing the transversal sealing seams 102' is terminated.

For this purpose as illustrated in FIG. 5*c*1 the bar shaped folding device 18 advantageously extends in the transversal direction 11 at the most over the portion of the groove 25*a* and at the most slightly beyond it on both sides.

As illustrated in FIGS. 5*d*1, 5*d*2 the lateral protrusions 101*a*, 101*b* of the foil hose 101 are pressed against each other from above and below and sealed by sealing bars 19*a, b* which engage the overhand 101*a, b* from above and from below and which approach each other, and which extend in the pass through direction 10 over an entire extension not the foil hose 101 and which also seal the folded over fin 101*c* that is provided in the overhang 101*a, b*.

Since the sealing bars 19*a, b* are typically approached from a side in an offset condition in order to receive the overhangs 101*a, b* between each other a folding device 18 that protrudes far in the transversal direction 11 beyond the groove 25*a* would lead to collisions with the sealing bars 19*a, b*.

When plural foil hoses 101 are arranged on a slide 120 aligned behind one another in the pass through direction 10 the sealing bars 19, b can continue over plural or all foil hoses of the slide 120 and can jointed seal all of them transversally.

After producing the transversal sealing seam 102' the hose bag 102 is tightly closed about the product P and finished as illustrated in FIG. 5*e*1.

Only for the sake of completeness it is stated again that the individual preceding process steps are performed at different operating stations which are approached sequentially by the slide 120 in the pass through direction 10 as already described with respect to FIG. 2.

The invention claimed is:

1. A method for producing longitudinally and transversally sealed filled foil bags, comprising the steps of:

a) positioning at least one non-form stable, individual, finite foil sheet on one of a plurality of transport slides of a transport device, wherein the transport slide is movable independently from any other transport slide in a transport direction, b) retaining the at least one foil sheet on the transport slide by sucking the foil sheet against the transport slide, c) transporting the at least one foil sheet by the transport slide in the transport direction sequentially to processing stations where the following processing steps are being performed:

d) placing at least one product on the at least one foil sheet on the transport slide, e) fabricating a first sealing seam by placing two edge portions, that extend in the transport direction of the at least one foil sheet against each other and sealing them in a first sealing step thereby forming a foil hose, and f) fabricating two second sealing seams oriented transversally to the first sealing seam in a second sealing step in that two opposite portions of ends of the foil hose are placed against each other and sealed, over an entire width of the foil hose, at both ends at the same time, g) fabricating at least one filled and circumferentially sealed foil bag, wherein the at least one sealed foil bag is formed from an entire foil sheet of the at least one foil sheet and no leftover or cut off scrap remains.

2. The method according to claim 1, wherein in the first sealing step, the edge portions are sealed relative to each other over an entire length of the edge portions.

3. The method according to claim 2, wherein, in the first sealing step, the edge portions are sealed relative to each other while the transport slide with the at least one foil sheet moves in the transport direction along a sealing unit.

4. The method according to claim 3, wherein after producing the first sealing seam and before producing the two second sealing seams, a sealing fin that extends in the transport direction and radially protrudes from a remainder of the foil hose is folded against the remainder of the foil hose, and/or the sealing fin is arranged in a width portion of the at least one product in top view.

5. The method according to claim 3, wherein the two second sealing seams are produced in top view orthogonal to the first sealing seam in that either, the two second sealing seams are produced transverse to the transport direction while the slide with the foil hose stands still in the transport direction and a sealing unit in the transverse direction to the transport direction is fed to the slide for the sealing, or the two second sealing seams are produced in the transport direction in that the foil hose is rotated on the slide so that the two second sealing seams that are to be produced extend in the transport direction, and the two second sealing seams are produced while the slide with the at least one foil sheet moves in the transport direction along a sealing unit.

6. The method according to claim 1, wherein placing the two opposite edge portions of the at least one foil sheet against each other is performed for producing the first sealing seam, and/or folding a sealing fin with the first sealing seam while the slide with the at least one foil sheet moves in the transport direction along a folding unit, along a folding guide surface.

7. The method according to claim 1, wherein, in the first sealing step two adjacent sections of an identical strip shaped portion that extends in the transport direction or transverse thereto, orthogonally, edge portions of the at least one foil sheet are selected as the two edge portions that are to be placed against each other and sealed.

8. The method according to claim 7, wherein in the second sealing step two opposite edge portions of the at least one foil sheet that are not yet sealed together are placed against the two edge portions, which were sealed together in the first sealing step, and sealed.

9. The method according to claim 8, wherein the processing steps of placing at least one product and fabricating the first and second sealing seams in the first and second sealing steps are performed upon the at least one foil sheet that rests on the slide or the first and second sealing steps are performed by gluing, hot sealing, or ultra sound sealing.

10. The method according to claim 1, further comprising, placing either plural foil sheets adjacent to one another, behind one another in the transport direction on the slide, or placing only one foil sheet on the slide, and said steps of fabricating at least one bag and transporting the at least one foil sheet are performed multiple times in the transport direction and subsequently the transversally sealed foil hose is cut into plural hose bags that are respectively sealed circumferentially.

11. A machine for producing longitudinally and transversally sealed filled foil bags, according to preceding method claim 1, the machine comprising:

a transport device with plural transport slides that are displaceable independently from each other along the transport device and that include a retaining device including at least one suction cup for retaining at least one foil sheet resting on a transport slide;

arranged along the transport device in a pass through direction through the transport device are:

at least one placement station for applying at least one flat packaging material on a transport slide;

at least one filling station for applying at least one product onto the at least one packaging material that sits on the transport slide;

at least one erecting station for three dimensional shaping of the at least one flat packaging material to form a packaging, at least one sealing station for sealing the packaging, a control unit for controlling the transport device;

wherein, the at least one placement station is configured to apply a non-form stable, individual, finite foil sheet as the at least one packaging material, wherein the at least one placement station comprises a storage device comprising non-form stable, individual, finite foil sheets or a foil band to be cut into non-form stable, individual, finite foil sheets;

the at least one erecting station is configured to approach edge portions of the non-form stable foil sheet towards each other, by forming the foil sheet without stretching; and the at least one sealing station comprising a first sealing unit configured to form a first seam at the approached edge portions and at least one second sealing unit configured to form two second seams, at the same time, transverse to the first seam on the foil sheet so that the entire foil sheet is used to form the sealed filled foil bag and no leftover or cut off scrap remains.

12. The machine according to claim 11, wherein the transport slide includes a vacuum pump, or the transport slide includes at least one format plate configured as a placement surface wherein the at least one format plate is replaceable without tools and the foil sheet that is placed on the transport slide protrudes on at least one side in the transversal direction relative to the transport direction in top view beyond the transport slide and a surface area of the foil sheet is greater than a surface area of the at least one format plate, or the at least one format plate is pivotable, and rotatable, by at least 90° relative to a base element of the transport slide about a pivot axis that extends orthogonal to a main plane of the at least one format plate.

13. The machine according to claim 11, wherein the storage device of the placement station either includes a storage container for foil sheets, or a production unit for foil sheets which includes a storage roll for a foil band, and at least one cutting device for cutting off foil strips that extend in an axial direction of the storage roll from a free end of the foil band, and the at least one cutting device is for cutting the foil band or for cutting foil strips into plural foil sheets that are sequential in the axial direction.

14. The machine according to claim 11, wherein the erecting station is arranged after the filling station, or the erecting station includes guide surfaces which fold portions of the non-form stable foil sheet into a selected position and hold them in this position by moving the foil sheet along by the transport slide.

15. The machine according to claim 11, wherein the first sealing unit is positioned at the transport device fixed in place in the pass through direction wherein the first sealing unit is configured to produce at least one longitudinal seam that extends in the pass through direction at a foil sheet that runs in the pass through direction through the sealing station, or the at least one second sealing unit is positioned at the transport device, fixed in place in the pass through direction, wherein the at least one second sealing unit is configured to produce transversal sealing seams that extends in the transversal direction to the pass through direction horizontally or vertically at a foil sheet that is stationary in the pass through direction through the sealing station, and/or at least one of the first and second sealing units are a hot bar sealing unit or an ultrasound sealing unit.

16. The machine according to claim 11, wherein the device includes a rearrangement station to rearrange the sealed filled foil bags into an enveloping packaging, and the rearrangement station includes a further transport device for the enveloping packaging.

17. The machine according to claim 11, wherein a machine frame is provided that extends in the pass through direction in which multiple processing stations are arranged and in which the transport device with its transport direction is arranged in the pass through direction of the machine, or the storage device for the foil sheets is arranged laterally outside of the machine frame, wherein the storage device comprises a storage roll for a foil band which is advantageously oriented with its axis direction in the pass through direction.

* * * * *